US005476133A

United States Patent [19]

Torkelson

[11] Patent Number: 5,476,133

[45] Date of Patent: Dec. 19, 1995

[54] GATE LATCH

[76] Inventor: Loren H. Torkelson, 1215 24th St. West Suite 200, Billings, Mont. 59102

[21] Appl. No.: 273,647

[22] Filed: Jul. 12, 1994

[51] Int. Cl.[6] ..... A47H 23/00; E06B 3/80; E05C 19/06

[52] U.S. Cl. ..... 160/328; 292/303; 292/84; 292/152

[58] Field of Search ..... 292/84, 152, 303, 292/340, DIG. 13, DIG. 16, DIG. 29; 24/664, 665, 634, 587; 160/328

[56] References Cited

U.S. PATENT DOCUMENTS

| | | | |
|---|---|---|---|
| 196,940 | 11/1877 | Scofield | 24/664 |
| 906,452 | 12/1908 | McCleer . | |
| 1,053,765 | 2/1913 | Wren | 292/19 |
| 4,001,923 | 1/1977 | Frankel et al. | 24/665 |
| 4,458,392 | 7/1984 | Pogharian et al. | 24/664 |
| 4,587,695 | 5/1986 | Jensen | 24/634 |
| 4,683,934 | 8/1987 | Salsness | 160/328 |

*Primary Examiner*—Peter M. Cuomo
*Assistant Examiner*—Tuyet Pham
*Attorney, Agent, or Firm*—Zarley, McKee, Thomte, Voorhees & Sease; Dennis L. Thomte

[57] ABSTRACT

A gate latch for a wire gate which is mounted on the upper end of a wooden post for selectively retaining the wooden post of the wire gate therein. The gate latch includes a pocket which is positioned inwardly of a pair of post retention members. The insertion of the wooden post into the pocket of the latch causes the post retention members to deflect outwardly to permit the post to be received in the latch. The post may be removed from the latch by moving one or both of the retention members outwardly with respect to each other.

5 Claims, 3 Drawing Sheets

GATE LATCH

BACKGROUND OF THE INVENTION

1. Field of the Invention

This invention relates to a gate latch and more particularly to a gate latch for closing a post and wire gate.

2. Description of the Prior Art

Conventional wire gates are normally use to close the space between a pair of gate posts which are embedded in the ground. The wire gates are normally comprised of a plurality of wires, usually barbed wires, which are secured at one end to one of the gate posts and which have a post member secured to the other end thereof. When it is desired to close the gate, the lower end of the post member is normally positioned in a wire loop secured to the other gate post. The upper end of the post member is then forced into a position adjacent the gate post so that another loop may be passed over the upper end of the post member and the gate post.

Many attempts have been made at solving the difficult problem of closing the gate. To date, it is not believed that anyone has satisfactorily solved the problem although many attempts have been made. Perhaps the most difficult and dangerous task in closing the gate is the problem associated with maintaining the upper end of the post member in position as the wire loop is extended over the upper end of the post member.

SUMMARY OF THE INVENTION

A gate latch is described which is adapted for use in closing a wire gate which extends between a pair of gate posts embedded in the ground. The gate latch of this invention comprises an upper receptacle including a base portion which is secured to the upper end of the gate post and which has a pair of supports extending horizontally therefrom in a horizontally spaced condition. A post retainer is provided at the outer end of each of the supports which extend inwardly towards one another to at least partially close the opening therebetween. As the upper end of the post member of the gate is moved towards the gate post, the post retainers deflect outwardly to enable the post member to pass thereby. As soon as the post member has passed by the post retainers, the post retainers automatically move towards one another to retain the post in the pocket defined thereby. A release member is connected to each of the retainers so that the post may be released from the upper receptacle from either side of the gate. Preferably, the retainers and the associated release members are integrally formed and are comprised of a spring steel material.

It is therefore a principal object of the invention to provide an improved gate latch.

Yet another object of the invention is to provide a gate latch including a receptacle which automatically retains the upper end of the post member therein once the post has been moved past a pair of resilient retainers.

Still another object of the invention is to provide a gate latch of type described above which permits the release of the post member therefrom from either side of the gate.

These and other objects will be apparent to those skilled in the art.

DESCRIPTION OF THE PREFERRED EMBODIMENT

Figure 1:
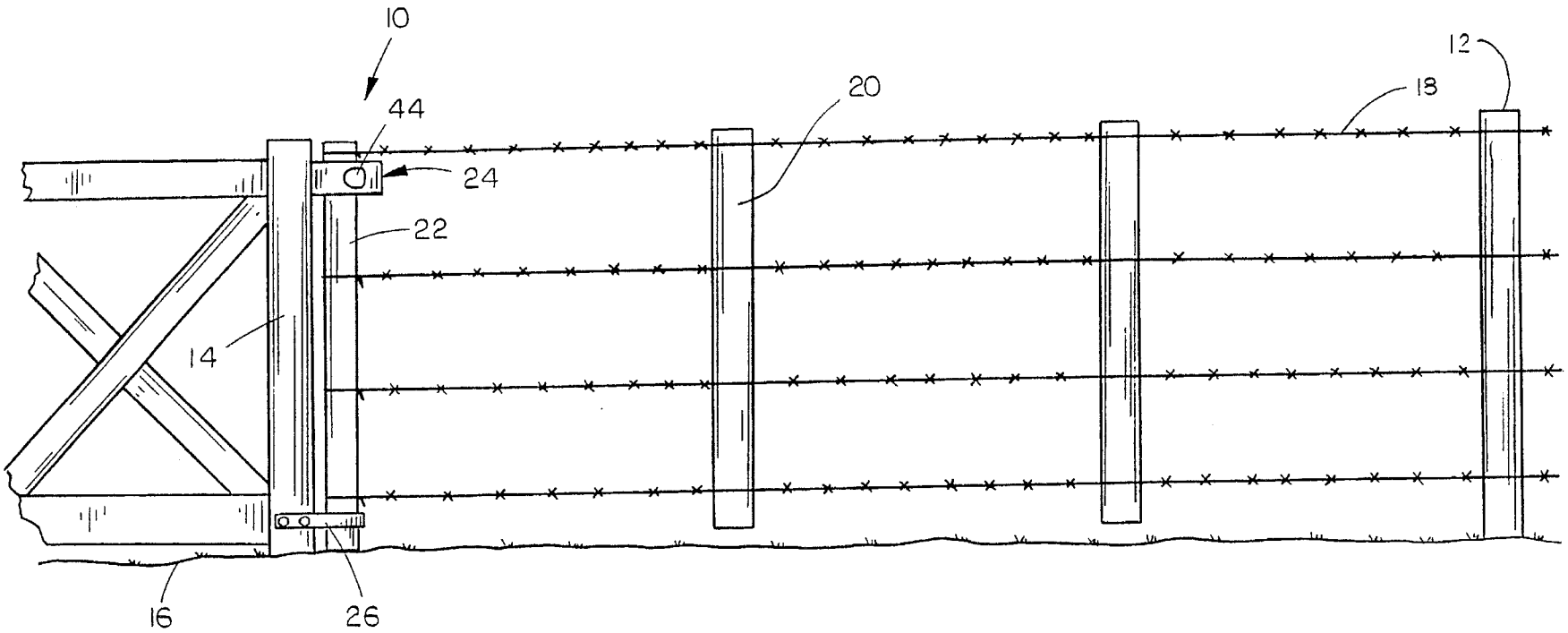
FIG. 1 is a side view of a wire gate having the gate latch of this invention mounted thereon.

Referring to the drawings, the numeral 10 refers to a conventional wire gate which is adapted to be extended between a pair of gate posts 12 and 14 which are embedded in the ground 16. Conventional wires usually of the barbed type extend from the gate posts 12 and 14 in conventional fashion.

Gate 10 comprises a plurality of wire members 18 which are secured to gate post 12 and which extend therefrom. Normally, one or more intermediate post members 20 are secured to the wire members 18. An end post member 22 is secured to the "free" ends of the wire members 18 as illustrated in the drawings and normally has a length greater than the intermediate post members 20.

The gate latch of this invention is referred to generally by the reference numeral 24 and is designed to maintain the post member 22 in the position illustrated in FIG. 1 so that the space between the gate posts 12 and 14 will be closed by the gate 10.

The numeral 26 refers to a conventional lower receptacle or first connection means which is secured to the lower end of gate post 14 which is substantially U-shaped so that it may receive the lower end of the post member 22 as illustrated in the drawings. The lower receptacle 26 may be comprised of either the strap type loop or one which is formed by wrapping wire around the lower end of the gate post 14 wherein a substantially U-shaped member is provided which can receive the lower end of the gate post member 22.

Figure 2:
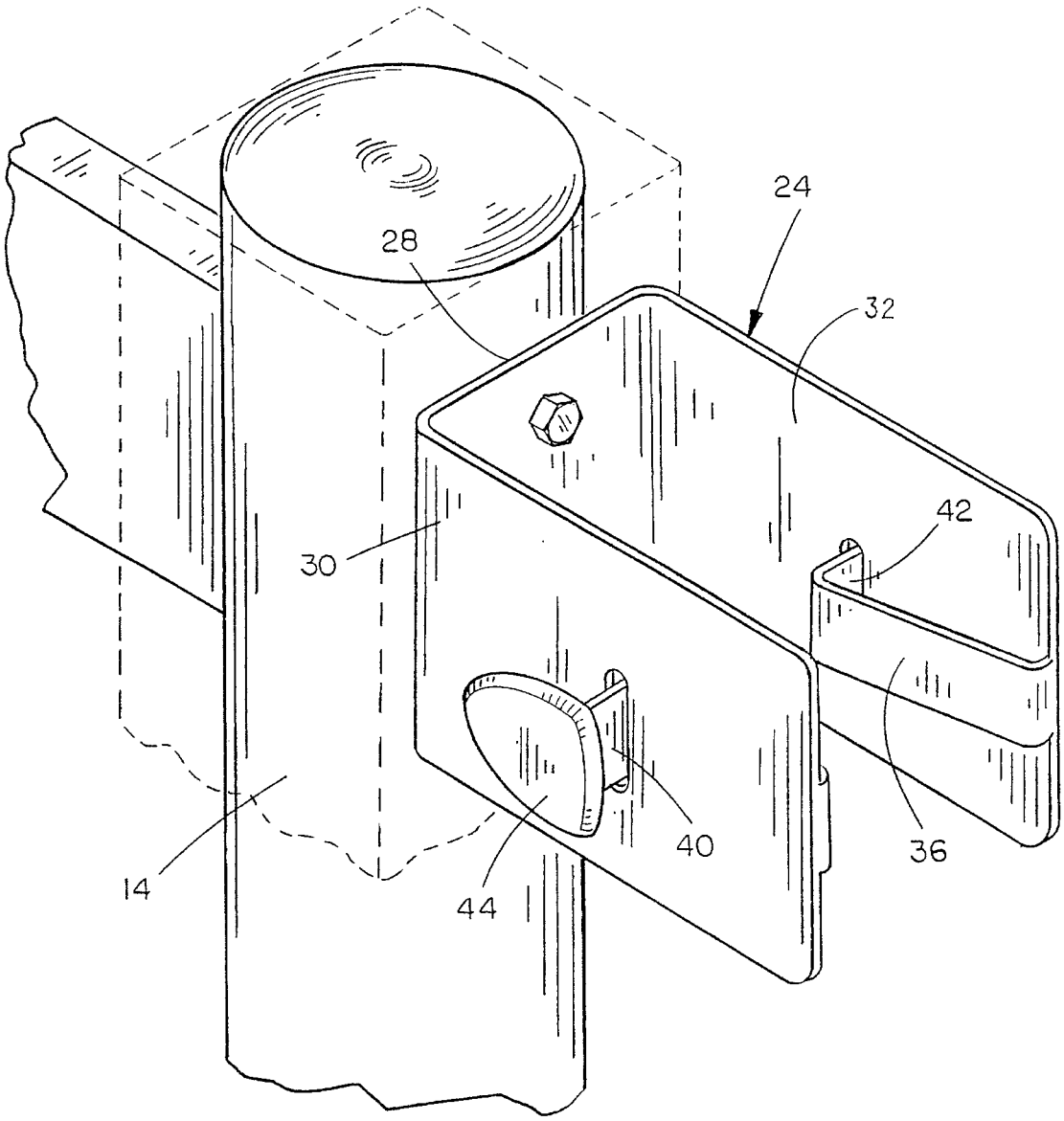
FIG. 2 is a perspective view of the gate latch of this invention.

Gate latch or upper receptacle 24 includes a flat base portion 28 which is screwed or nailed to the post 14. If the post 14 is square, as illustrated by broken lines in FIG. 2, or rectangular, base portion 28 will be flat as described. However, if a "round" or cylindrical gate post is being used, base portion 28 will preferably be arcuate in shape to correspond to the outer surface of the gate post.

Figure 3:
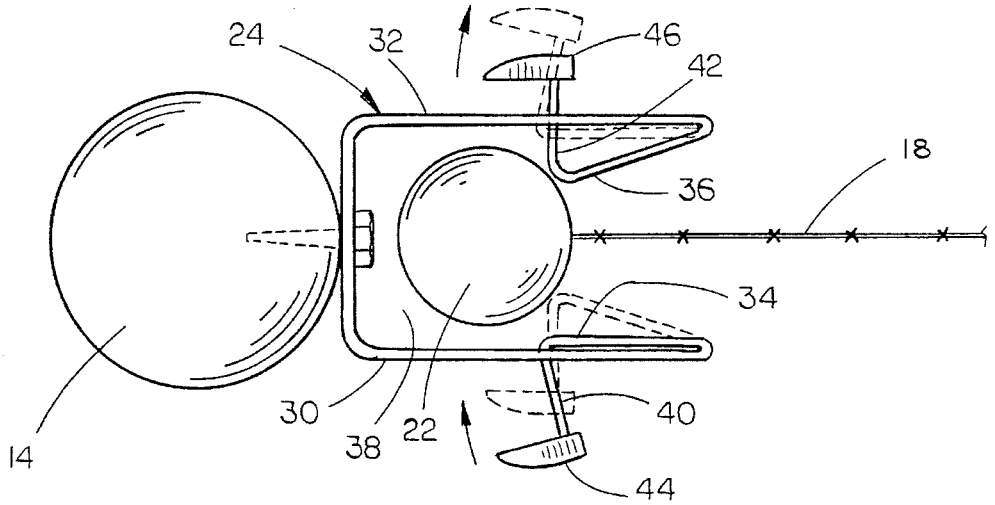
FIG. 3 is a top view of the gate latch of this invention with the broken fines illustrating the positions which the latch members may move.
Figure 4:
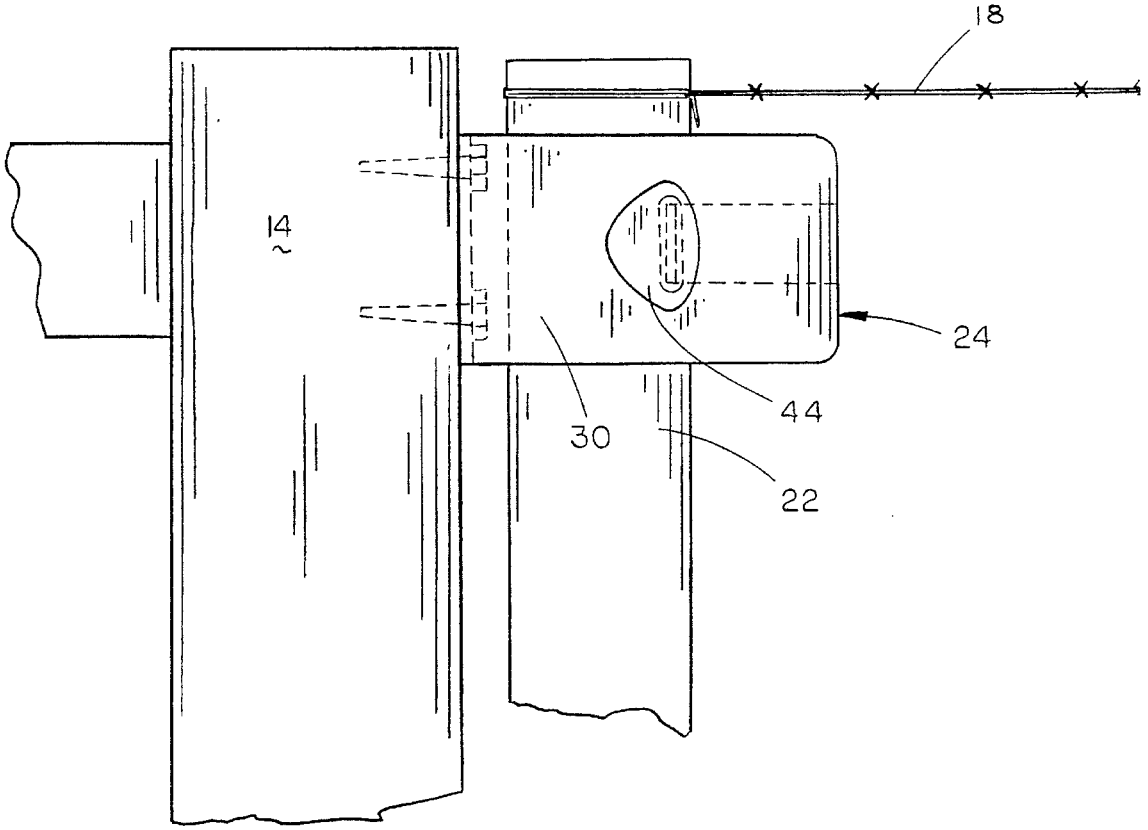
FIG. 4 is a side view of the gate latch of this invention.

A pair of flat supports 30 and 32 extend from the opposite sides of the base portion 28 in a spaced-apart condition as illustrated in FIG. 3. The inner ends of the supports 30 and 32 terminate in retainer portions 34 and 36 which extend back towards the post 14 and towards one another as also illustrated in FIG. 3. As seen in FIG. 3, when the retainers 34 and 36 are in their normal condition, they at least partially close the space between the supports 30 and 32 to define a pocket 38 between the inner ends of the retainers and the base portion 28.

Preferably, the inner ends of the retainers 34 and 36 terminate in outwardly extending release members 40 and 42 which extend through suitable openings formed in the supports 30 and 32 as illustrated in the drawings. Handles 44 and 46 are secured to the release members outwardly of the supports 30 and 32 respectively to enable a person to move the retainers from their normal retaining position to a position so that the post 22 may be released or removed from the pocket 38. Preferably, the supports 30 and 32 and the retainers 34 and 36 are comprised of a spring steel material so that the retainers will normally be in the position so as to prevent the post from being pulled from the pocket 38.

When it is desired to close the gate, the lower end of the post member 22 is inserted into the lower receptacle 26. The upper end of the post member 22 is then moved towards the upper receptacle 24 and is pushed between the retainers 34 and 36. As the upper end of the post member 22 is moved between the retainers 34 and 36, the retainers will move outwardly towards the supports 30 and 32 respectively so that the post member 22 may pass therebetween. As soon as the post member 22 has been received in the pocket 38, the resilient retainers 34 and 36 move to their closed position so as to retain the post member 22 in the pocket 38. The operation just described enables the gate to be easily closed without the necessity of the post member 22 being forced towards the gate post 14 and simultaneously attempting to pass a wire loop or the like over the upper end of the post. In the use of the gate latch described herein, a person may exert as much force as necessary on the upper end of the post member 22 to cause the post member 22 to be received in the pocket 38.

When it is desired to open the gate, the post member 22 may be released from the pocket 38 from either side of the gate by simply grasping one of the handles 44 and 46 and pulling the same outwardly with respect to the receptacle 24 so that the post member 22 may be removed from the pocket 38. In most situations, there will be sufficient tension on the wires 18 in the gate 10 so that the post member 22 will be automatically pulled from the upper receptacle 24 once either of the retainers 34 and 36 have been moved to their open position.

Thus it can be seen that a novel gate latch has been provided which is extremely easy to use but which securely maintains the gate in its closed position. It can therefore be seen that the invention accomplishes at least all of its stated objectives.

I claim:

1. In combination:

first and second vertically disposed and horizontally spaced-apart gate posts;

a plurality of substantially horizontally disposed and vertically spaced elongated wire members secured at one end to said first gate post and extending therefrom towards said second gate post;

a post member secured to the other ends of said wire members and adapted to be positioned adjacent said second gate post, said post member having upper and lower ends;

a lower receptacle on said second gate post for receiving and holding the lower end of said post member;

an upper receptacle on said second gate post above said lower receptacle for receiving and holding the upper end of said post member;

said upper receptacle including an inner end positioned adjacent said second gate post and an outer end positioned outwardly thereof;

said upper receptacle having a post retention means at its outer end which is movable between a post receiving position and a post retention position;

said upper receptacle having a pocket inwardly of said post retention means;

the receiving of said post member into said pocket of said upper receptacle causing said post retention means to move from its post retention position to its post receiving position;

said post retention means automatically moving from its said post receiving position to its post retention position once said post member has been received by said pocket;

and release means connected to said post retention means to enable said post retention means to be selectively moved to its post receiving position so that said post member may be disconnected from said upper receptacle;

said post retention means comprising a pair of oppositely disposed post retainers.

2. The combination of claim 1 wherein said release means comprises a release member secured to each of said post retainers.

3. The combination of claim 2 wherein said post member may be removed from said pocket by releasing either of said release members.

4. In combination:

first and second vertically disposed and horizontally spaced-apart gate posts;

a plurality of substantially horizontally disposed and vertically spaced elongated wire members secured at one end to said first gate post and extending therefrom towards said second gate post;

a post member secured to the other ends of said wire members and adapted to be positioned adjacent said second gate post, said post member having upper and lower ends;

a lower receptacle on said second gate post for receiving and holding the lower end of said post member;

an upper receptacle on said second gate post above said lower receptacle for receiving and holding the upper end of said post member;

said upper receptacle including an inner end positioned adjacent said second gate post and an outer end positioned outwardly thereof;

said upper receptacle having a post retention means at its outer end which is movable between a post receiving position and a post retention position;

said upper receptacle having a pocket inwardly of said post retention means;

the receiving of said post member into said pocket of said upper receptacle causing said post retention means to move from its post retention position to its post receiving position;

said post retention means automatically moving from its said post receiving position to its post retention position once said post member has been received by said pocket;

and release means connected to said post retention means to enable said post retention means to be selectively moved to its post receiving position so that said post member may be disconnected from said upper receptacle;

said upper receptacle comprising a base portion which is secured to said second gate post; first and second horizontally spaced supports extending horizontally from said base portion towards said first gate post; each of said supports having retainer portions at their outer ends which extend towards one another to at least partially close the space between said supports and to define said pocket; said release means comprising a release member secured to each of said retainer portions for moving the respective retainer portion towards its respective support.

5. The combination of claim 4 wherein each of said release members extends through its associated support whereby said post may be released from said pocket from either side of said upper receptacle.

* * * * *